US006971135B2

(12) United States Patent
Nadler

(10) Patent No.: US 6,971,135 B2
(45) Date of Patent: Dec. 6, 2005

(54) INFLATABLE STUFFING FOR FOOTWEAR

(75) Inventor: Thomas I. Nadler, West Orange, NJ (US)

(73) Assignee: World Packaging Inc., North Arlington, NJ (US)

( * ) Notice: Subject to any disclaimer, the term of this patent is extended or adjusted under 35 U.S.C. 154(b) by 0 days.

(21) Appl. No.: 10/833,751

(22) Filed: Apr. 28, 2004

(65) Prior Publication Data

US 2005/0241081 A1 Nov. 3, 2005

(51) Int. Cl.[7] ..... A43D 3/00

(52) U.S. Cl. ..... 12/128 R; 12/114.4

(58) Field of Search ..... 12/114.4, 128 R

(56) References Cited

U.S. PATENT DOCUMENTS

| | | | | | |
|---|---|---|---|---|---|
| 291,188 | A | * | 1/1884 | Higgins | 12/114.4 |
| 300,365 | A | * | 6/1884 | Higgins | 12/114.4 |
| 795,217 | A | * | 7/1905 | Gaunt | 12/114.4 |
| 1,086,782 | A | * | 2/1914 | Moore | 12/114.4 |
| 2,538,247 | A | * | 1/1951 | Holt | 12/114.4 |
| 3,483,580 | A | * | 12/1969 | Cherry et al. | 12/114.4 |
| 5,341,532 | A | * | 8/1994 | Markowitz | 12/114.4 |

* cited by examiner

*Primary Examiner*—Ted Kavanaugh
(74) *Attorney, Agent, or Firm*—Kirschstein, et al.

(57) ABSTRACT

An inflatable stuffing is inserted into and removed from footwear. The stuffing has an insert and a gas inlet. The inlet allows gas to be admitted into the insert. A toe region of the insert is bent to the right or the left about a pivot seal to more fully support a curved toe portion of a shoe.

7 Claims, 2 Drawing Sheets

INFLATABLE STUFFING FOR FOOTWEAR

BACKGROUND OF THE INVENTION

1. Field of the Invention

The present invention generally relates to stuffed footwear and, more particularly, to an inflatable stuffing for insertion into, and removal from, footwear, as well as to a stuffing that reliably maintains the shape of both right and left shoes.

2. Description of the Related Art

When not worn, shoes are often stuffed with shoe forms to maintain their shape and resist wrinkling of the material constituting the upper shoe part. Shoe forms utilizing tension springs, or outwardly-acting biasing clamps, or bags filled with particulate filler are well known and are used by consumers, typically in a home and especially to maintain the shapes of expensive shoes or boots fabricated of leather and like light, thin materials.

Although the known shoe forms are satisfactory for their intended purpose, they are not generally employed to stuff shoes prior to their purchase primarily due to the prohibitive cost of the shoe forms. Shoe manufacturers that produce shoes in mass production typically stuff their shoes with multiple wads of crushed paper, which serves to maintain the shoe shapes during transport to retailers, and sometimes even during display at the retailers.

The stuffing of shoes with paper, however, has not proven to be altogether desirable. Foremost of all concerns is the cost of labor involved not only in initially stuffing each shoe, but also in removing the multiple wads of paper therefrom. At the manufacturing end, a multitude of crushed paper wads represents a non-negligible fire hazard. At the retailing end, the removed crushed paper wads are unsightly and must be discarded, thereby raising waste disposal concerns.

It is known to ship handbags, duffle bags, luggage and like soft-walled non-self-supporting bags with inflated inserts of generally parallelepiped configuration. Such bags have wide, usually zippered, openings commensurate in length with the length of the inflated inserts so that the inserts can be readily bodily inserted into the wide openings of such bags. In shoes, however, and especially in boots, the foot opening is much smaller than the length of the shoe and, hence, box-like inserts cannot be used to stuff shoes because the inserts would not reach the front toe portion of the shoe.

Hence, the prior art proposed in U.S. Pat. No. 5,341,532 the use of an L-shaped or foot-shaped inflatable stuffing for insertion into a shoe. As advantageous as this inflatable stuffing was in stuffing a shoe, the shape of the front toe portion of the shoe was still not adequately maintained. The shoes of a pair of shoes are, of course, not identical, but are mirror symmetrical. The toe portion of the shoe for the right foot curves to the left (as seen in top plan view), whereas the toe portion of the shoe for the left foot curves to the right (as seen in top plan view). The inflatable stuffing, as embodied by U.S. Pat. No. 5,341,532, was adequate in maintaining the shape of the shoe into which it was inserted, except at the curved toe portion where the leading toe region of the insert did not seat fully therein and left a non-negligible toe space which was not stuffed and, hence, was prone to collapse, thereby marring the appearance of the footwear.

SUMMARY OF THE INVENTION

OBJECTS OF THE INVENTION

Accordingly, it is a general object of this invention to provide a dependable, inexpensive, inflatable stuffing for insertion into and removal from footwear.

More particularly, it is an object of the present invention to eliminate the requirement for stuffing shoes with crushed paper.

Still another object of the present invention is to reduce the cost of stuffing shoes and of removing the stuffing from shoes.

It is yet another object of the present invention to remove footwear stuffing in one motion without having to repetitively remove individual pieces of stuffing.

A still further object of the present invention is to reliably stuff, and maintain the shape of, the toe portion of both right and left shoes.

FEATURES OF THE INVENTION

In keeping with the above objects and others which will become apparent hereinafter, one feature of the present invention resides, briefly stated, in a stuffing for inserting into, and maintaining a shape of, a shoe having a curved toe portion. The stuffing includes an insert extending along a longitudinal axis between a heel region and a toe region. The insert has overlying planar sheets of synthetic plastic material bounding an interior, and a pivot seal for heat sealing the sheets together at a pivot region intermediate the heel and toe regions.

The stuffing also includes an inlet having overlying planar strips of synthetic plastic material bounding a passage into the interior of the insert through which a gas is admitted to inflate the insert.

In accordance with this invention, the toe region of the insert, after inflation, is bent at the pivot region about a pivot axis perpendicular to the longitudinal axis into an arcuate shape that conforms to the curved toe portion of the shoe. Thus, the curved toe region of the insert is more fully seated within the curved toe portion of the shoe and resists collapse of the curved toe portion, thereby improving the appearance of the shoe. The same stuffing can be used for both right and left shoes, the toe region curving to the right or the left as required.

In the preferred embodiment, the pivot seal is a toroid and is centrally located on the longitudinal axis. Likewise, the inlet is elongated and extends centrally along the longitudinal axis through the heel region.

Removal of the inflated insert is advantageously performed in a single motion or stroke merely by pulling on the inlet. This feature, of course, obviates the prior art necessity of repetitively removing multiple stuffing materials.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
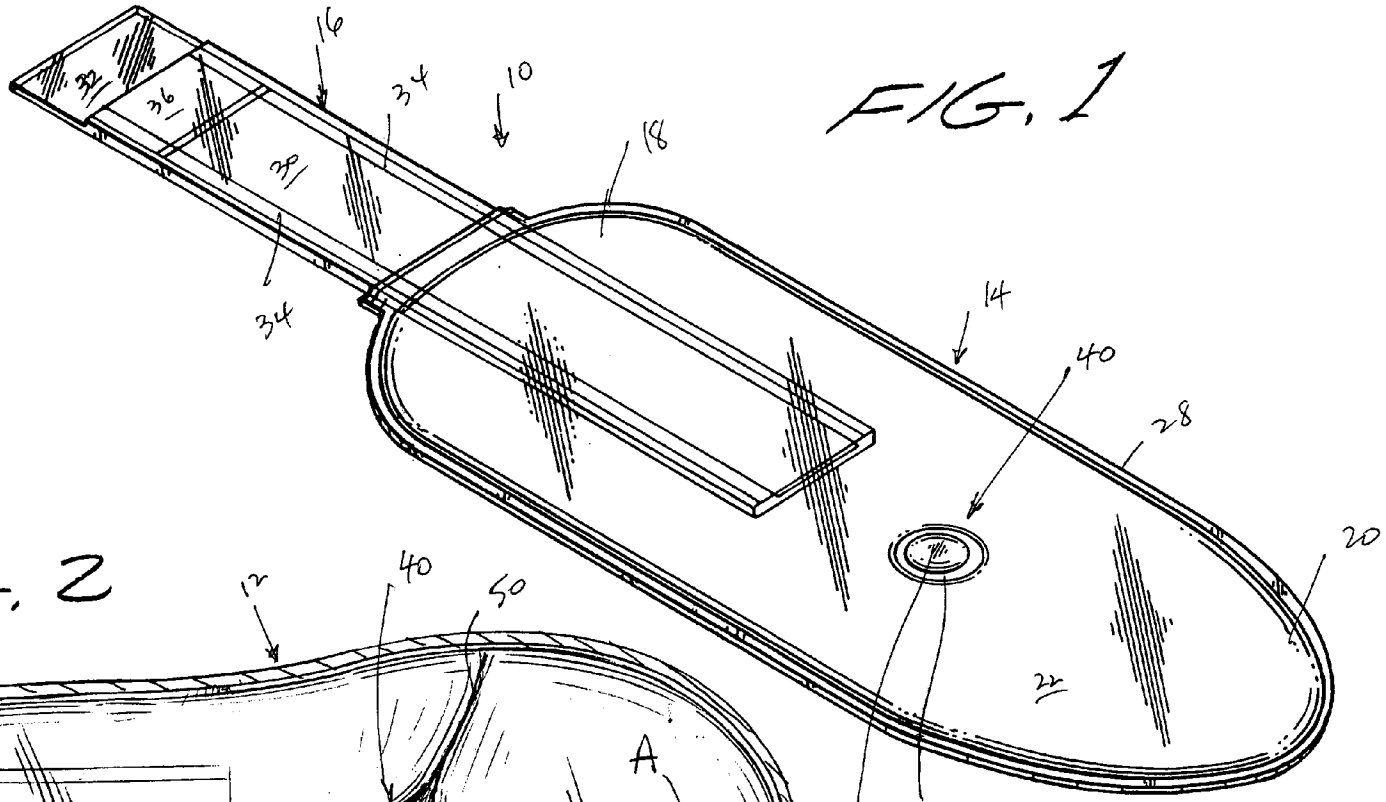
FIG. 1 is a front perspective view of a stuffing prior to inflation according to this invention.

Referring now to the drawings, reference numeral 10 generally identifies a stuffing for insertion into a shoe 12 (see FIGS. 2–4) and for removal from the shoe 12. Stuffing 10 includes an inflatable insert 14 and a gas inlet 16 integral therewith. As explained below, gas such as air is introduced under pressure into the inlet 16 to inflate the insert 14. The insert is preferably inflated prior to insertion into the shoe, but could equally well be inflated in situ within the shoe.

Insert 14 extends along a longitudinal axis between a heel region 18 and a toe region 20. The insert 14 includes overlying planar sheets 22, 24 (see FIG. 4) of synthetic plastic material bounding an interior 26. The sheets may be discrete, or the insert may be a tubular sleeve flattened to form the overlying sheets. Peripheral edges of the sheets are heat-fused together by application of heat and pressure along a peripheral seam 28 to seal the interior of the insert.

The inlet 16 includes overlying planar strips 30, 32 of synthetic plastic material bounding a passage through which gas is admitted into the interior 26 of the insert to inflate the same. The strips may be discrete, or the inlet may be a tubular sleeve flattened to form the overlying strips. Peripheral longitudinal edges of the strips are heat-fused together by application of heat and pressure along longitudinal seams 34 to bound the passage. The opposite ends of the passage are not fused together. The outer end of strip 30 may be folded over onto itself to form closure flap 36. The strips are centrally located on the insert and are parallel to the longitudinal axis. The strips extend between the exterior and the interior of the insert and pass between the sheets 22, 24 through the heel region 18.

A pivot seal 40 is provided for heat sealing the sheets together by application of heat and pressure at a pivot region intermediate the heel 18 and toe 20 regions. In the preferred embodiment, the pivot seal 40 is a toroid and has a ring-shaped sealed part 38 surrounding a circular, unsealed, core part 42. The pivot seal is centrally located on the insert on the longitudinal axis.

A non-illustrated filling nozzle, similar to a drinking straw, is inserted into inlet 16 to admit pressurized gas, e.g., air, from a non-illustrated air pump source. Once fully inflated, the nozzle 32 is removed, and the inlet 16 is sealed by either heat-fusing an open end of the inlet 16, and/or automatically by incorporating a normally-closed check valve within the open end. The check valve is constituted by the foldable flap 36. The nozzle is inserted between the flap and the other strip 32 for inflation purposes. Upon removal of the nozzle, the interior air pressure within the insert forces the flap against the other strip 32, thereby sealing the insert.

Figure 2:
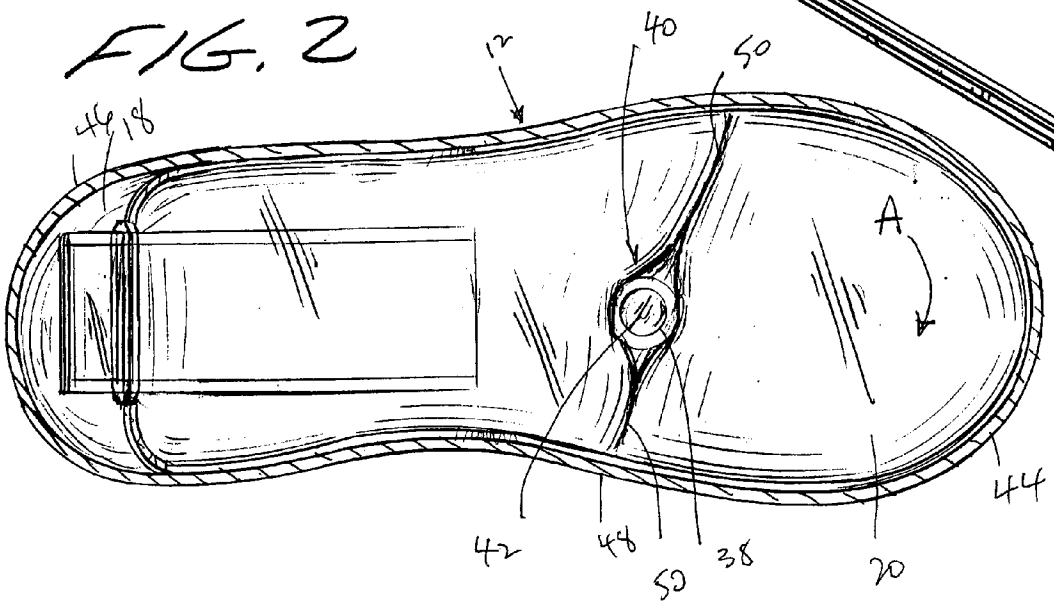
FIG. 2 is a top plan view of the stuffing of FIG. 1 after inflation in a left shoe.
Figure 3:
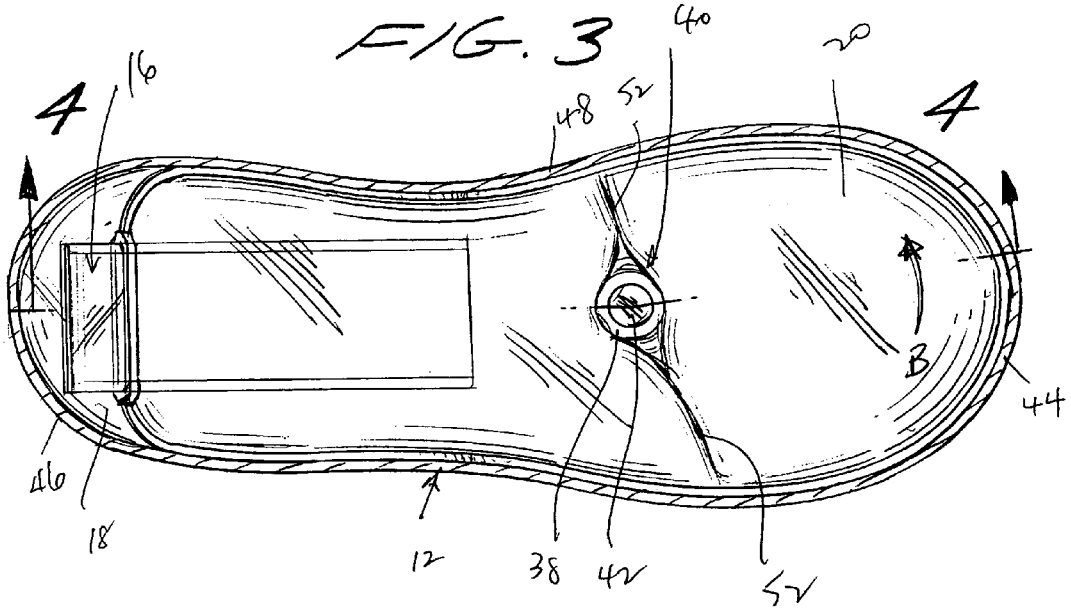
FIG. 3 is a top plan view of the stuffing of FIG. 1 after inflation in a right shoe.
Figure 4:
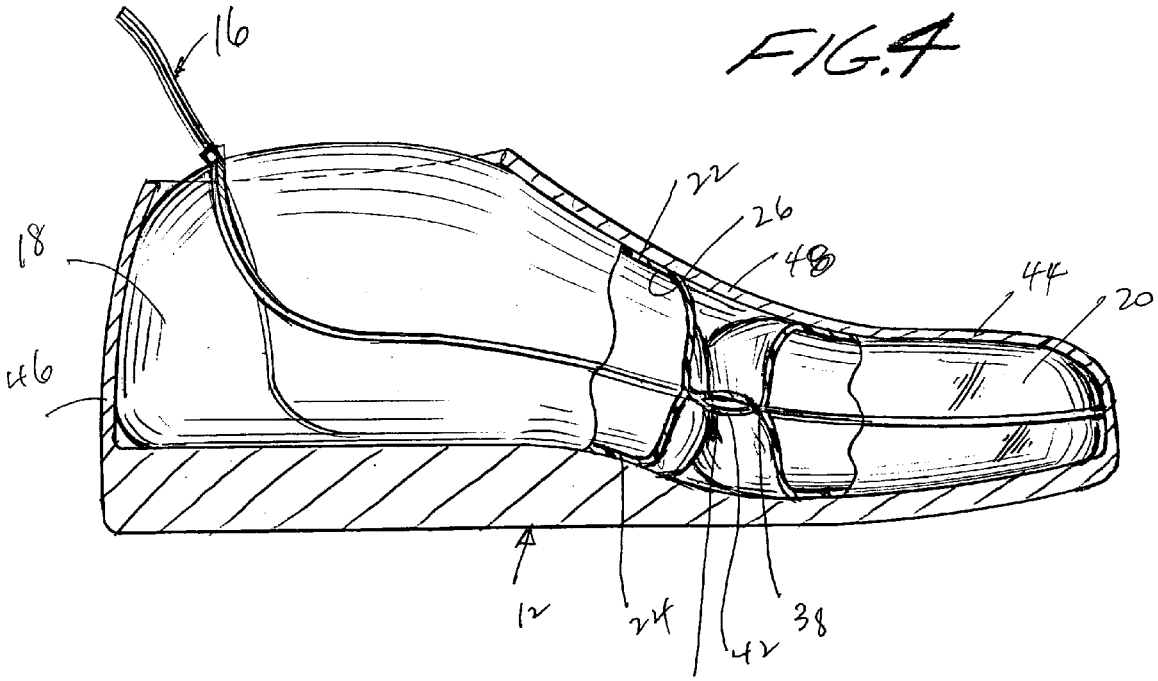
FIG. 4 is a sectional view taken on line 4—4 of FIG. 3.

FIG. 2 depicts the inflated stuffing in a left shoe, and FIG. 3 depicts the inflated stuffing in a right shoe. Each shoe has a curved toe portion 44, a heel portion 46, and a sole portion 48. The curved toe portion 44 pushes the toe part 20 of the inflated insert at the pivot region about a pivot axis perpendicular to the longitudinal axis into an arcuate shape that conforms to the curved toe portion 44. Thus, as shown in FIG. 2, the insert is stressed at creases 50 and is bent in the direction of arrow A. As shown in FIG. 3, the insert is stressed at creases 52 and is bent in the direction of arrow B. In each case, the pivot seal 40 enables the movement of the toe part 20 so that it is more deeply seated within and more completely fills the toe space within the toe portion 44. The material of the shoe upper at the toe portion is thus supported more fully and resists wrinkling and creasing.

To remove the insert, one need only grasp the inlet and pull the insert from the shoe with a single motion.

Each insert can accommodate shoe sizes within a limited range. Of course, different stuffings would be required for shoe sizes outside of said range.

Once removed, or even prior to removal, the stuffing may be pierced to deflate the insert, thereby simplifying the removal procedure and waste disposal concerns.

It will be understood that each of the elements described above, or two or more together, also may find a useful application in other types of constructions differing from the types described above.

For example, the pivot seal need not be toroidal as shown, but can be a circular spot weld, or at least a heat-fused seam extending along an arcuate path.

It will be understood that each of the elements described above, or two or more together, also may find a useful application in other types of constructions differing from the types described above.

While the invention has been illustrated and described as embodied in an inflatable stuffing for footwear, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A stuffing for inserting into, and maintaining a shape of, a shoe having a curved toe portion, comprising:

a) an insert extending along a longitudinal axis between a heel region and a toe region, the insert including overlying planar sheets of synthetic plastic material bounding an interior, and a pivot seal for heat sealing the sheets together at a pivot region intermediate the heel and toe regions;

b) an inlet including overlying planar strips of synthetic plastic material bounding a passage into the interior of the insert through which a gas is admitted to inflate the insert; and c) the toe region of the insert, after inflation, being bent at the pivot region about a pivot axis perpendicular to the longitudinal axis into an arcuate shape that conforms to the curved toe portion of the shoe.

2. The stuffing of claim 1, wherein the sheets have peripheral edges heat-fused together along a peripheral seam to seal the interior of the insert.

3. The stuffmg of claim 2, wherein the peripheral seam lies in a plane parallel to each sheet in an uninflated state of the insert.

4. The stuffing of claim 1, wherein the pivot seal has a toroidal shape.

5. The stuffing of claim 1, wherein the pivot seal lies centrally on the insert.

6. The stuffing of claim 1, wherein the strips have peripheral edges heat-fused together along longitudinal seams to seal the passage.

7. The stuffing of claim 5, wherein the longitudinal seams are parallel to the longitudinal axis and extend through the heel region.

* * * * *